US007582824B2

(12) United States Patent
Sumita

(10) Patent No.: US 7,582,824 B2
(45) Date of Patent: Sep. 1, 2009

(54) TEMPO DETECTION APPARATUS, CHORD-NAME DETECTION APPARATUS, AND PROGRAMS THEREFOR

(75) Inventor: Ren Sumita, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 0 days.

(21) Appl. No.: 12/015,847

(22) Filed: Jan. 17, 2008

(65) Prior Publication Data

US 2008/0115656 A1 May 22, 2008

Related U.S. Application Data

(63) Continuation of application No. PCT/JP2005/023710, filed on Dec. 26, 2005.

(30) Foreign Application Priority Data

Jul. 19, 2005 (JP) ..... 2005-208062

(51) Int. Cl.
*G04B 13/00* (2006.01)
*G10H 1/00* (2006.01)

(52) U.S. Cl. ..... 84/612; 84/609; 84/615; 84/616; 84/636; 84/649; 84/652; 84/653; 84/654; 84/668

(58) Field of Classification Search ..... None
See application file for complete search history.

(56) References Cited

U.S. PATENT DOCUMENTS 7,181,021 B2 * 2/2007 Raptopoulos et al. .... 381/71.14

FOREIGN PATENT DOCUMENTS

JP 3127406 B2 11/1992

(Continued)

OTHER PUBLICATIONS

Masataka Goto, "Real-time Beat Tracking System", Computer Science Magazine Bit, 1996, vol. 28, No. 3, Kyoritsu Shuppann.

(Continued)

*Primary Examiner*—Marlon T Fletcher
(74) *Attorney, Agent, or Firm*—Sughrue Mion, PLLC

(57) ABSTRACT

There is provided a tempo detection apparatus capable of detecting, from the acoustic signal of a human performance of a musical piece having a fluctuating tempo, the average tempo of the entire piece of music and the correct beat positions, and further, the meter of the musical piece and the position of the first beat. The tempo detection apparatus includes an input section; a chromatic-note-level detection section for applying an FFT calculation to obtain the level of each chromatic note at each of predetermined timings; a beat detection section for summing up incremental values of respective levels of all the chromatic notes, indicating the degree of change of entire sound at each of the predetermined timings, and for detecting an average beat interval and the position of each beat from the total of the incremental values of the levels; and a measure detection section for calculating the average level of each chromatic note for each beat, for summing up incremental values of all the chromatic note for each beat to obtain a value indicating the degree of change, and for detecting a meter and the position of a measure line from the value indicating the degree of change of entire sound at each beat.

(Continued)

10 Claims, 9 Drawing Sheets

U.S. PATENT DOCUMENTS

| | | | | |
|---|---|---|---|---|
| 2003/0026436 | A1* | 2/2003 | Raptopoulos et al. | 381/71.4 |
| 2008/0034948 | A1* | 2/2008 | Sumita | 84/636 |
| 2008/0188967 | A1* | 8/2008 | Taub et al. | 700/94 |
| 2008/0190271 | A1* | 8/2008 | Taub et al. | 84/645 |
| 2008/0190272 | A1* | 8/2008 | Taub et al. | 84/645 |
| 2008/0210082 | A1* | 9/2008 | Sumita | 84/603 |
| 2008/0282872 | A1* | 11/2008 | Ma et al. | 84/627 |

FOREIGN PATENT DOCUMENTS

| | | | |
|---|---|---|---|
| JP | 4336599 | A | 11/1992 |
| JP | 527751 | A | 2/1993 |
| JP | 5173557 | A | 7/1993 |
| JP | 3231482 | B2 | 12/1994 |
| JP | 7295560 | A | 11/1995 |
| JP | 926790 | A | 1/1997 |
| JP | 10134549 | A | 5/1998 |
| JP | 2876861 | B2 | 1/1999 |
| JP | 3156299 | B2 | 2/2001 |
| JP | 2002116754 | A | 4/2002 |

OTHER PUBLICATIONS

Masataka Goto, et al. "Onkyo Shingo ni Taisuru Real Time Beat Tracking-Dagakkion o Fukumanai Ongaku ni Taisuru Beat Tracking", Information Processing Society of Japan Kenkyu Hokoku, Ongaku Joho Kagaku, 1996, pp. 14-20, 96-MUS-16-3.

* cited by examiner

When $\sigma = \sqrt{\dfrac{-1}{2 \cdot \log_e(0.4)}}$, $$k = e^{-\frac{\left|\frac{s}{\tau_{max} \cdot F}\right|^3}{2 \cdot \sigma^2}}$$

Fig. 15

| | | | |
|---|---|---|---|
| 1 C Gsus4 | 2 Gsus4/C Gsus4 | 3 C Gsus4 | 4 F C |
| 5 F/C | 6 G | 7 G | 8 CM7/8 A7sus4 |
| 9 C Gsus4 | 10 C Gsus4 | 11 C Gsus4 | 12 F Am |
| 13 Fadd9/F# | 14 G#mM7-5 G/A# | 15 Bm7 G | 16 Gsus4/B A7sus4/G |
| 17 Gsus4 | 18 Gsus4 | 19 Gsus4 | 20 C/B Gsus4 |
| 21 /G | 22 C G6 | 23 Asus4 D | 24 Dsus4/E |
| 25 C | 26 C | 27 Em/F | 28 CM7/8 Asus4/G |
| 29 G7 | 30 C G6 | 31 GM7 | 32 C |
| 33 /F | 34 /F | 35 /F | |

TEMPO DETECTION APPARATUS, CHORD-NAME DETECTION APPARATUS, AND PROGRAMS THEREFOR

BACKGROUND OF THE INVENTION

1. Field of the Invention

The present invention relates to a tempo detection apparatus, a chord-name detection apparatus, and programs for these apparatuses.

2. Discussion of Background

In a conventional automatic musical accompaniment apparatus, the user specifies a tempo of performance in advance and automatic accompaniment is conducted according to the tempo. When a player gives a performance with this automatic accompaniment, the player needs to play according to the tempo of the automatic accompaniment. It is very difficult especially for a novice player to perform in that way. Therefore, an automatic accompaniment apparatus has been demanded which automatically detects the tempo of the performance of a player from the sound of the performance and performs automatic accompaniment according to the tempo.

In a music-transcription apparatus for detecting chords and musical-notation information from a sound source such as a music CD containing recorded performance sound, a function of detecting the tempo from the performance sound is required as a process in a stage prior to transcribing a melody.

One such tempo detection apparatus is disclosed, for example, in Japanese Patent No. 3,231,482.

This tempo detection apparatus includes tempo change section which detects, based on performance information indicating the tone, sound volume and sound timing of each note in externally input performance sound, an accent caused by the sound volume and an accent caused by a musical factor other than the sound volume. The tempo change means predicts change of tempo based on performance information according to these two accents, and adjusts an internally produced tempo to follow the predicted tempo. Therefore, it is necessary to detect musical-notation information in order to detect the tempo. When a musical instrument such as a MIDI device having a function to output musical-notation information, is used for performance, musical-notation information can be obtained easily. However, if an ordinary musical instrument not having such a function is used for performance, a music transcription technique for detecting musical notation information from the performance sound is required.

One tempo detection apparatus that receives performance sound, that is, an acoustic signal, of an ordinary musical instrument having no function for outputting musical-notation information, is disclosed, for example, in Japanese Patent No. 3,127,406.

In this tempo detection apparatus, an input acoustic signal is subjected to digital filtering in a time-division manner to extract chromatic notes, the generation period of the detected chromatic notes is detected from the envelop value of the note, and the tempo is detected according to the meter of the input acoustic signal, specified in advance, and the generation period of note. Since this tempo detection apparatus does not detect musical-notation information, the apparatus can be used in a pre-process of a music transcription apparatus which detects chords and musical-notation information.

A similar tempo detection apparatus is also described in "Real-time Beat Tracking System", Masataka Goto, Computer Science Magazine Bit, Vol. 28, No. 3, Kyoritsu Shuppann, 1996.

Chords are a very important factor in popular music. When a small band plays a popular music, they usually use a musical score called a chord score or a lead sheet having only a melody and a chord progression, not a musical score having musical notation to be played. Therefore, to play a musical piece such as that in a commercial CD with a band, it is necessary to transcribe the performance sound into chord progression of the musical piece. This work can be performed only by professionals having special musical knowledge and cannot be performed by ordinary people. Consequently, there have been demands for an automatic music transcription apparatus which detects chords from a musical acoustic signal with the use of e.g. a commercial personal computer.

Such an apparatus for detecting chords from a musical acoustic signal is disclosed in Japanese Patent No. 2,876,861. This apparatus extracts, candidates of fundamental-frequencies from a result of power-spectrum calculation, removes what seem to be harmonics from the candidates of fundamental-frequencies to detect musical-notation information, and detects the chords from this musical-notation information.

However, it has been known that it is very difficult for this apparatus to remove the harmonics because of difference of harmonic structure due to the difference of the types of musical instruments, difference of harmonic output due to the difference of key-hitting strength, changes of the power of harmonics with time, phase interference among notes having the same frequencies as harmonics, and others. In other words, it is not likely that the process for detecting musical-notation information always works correctly for sound sources such as general music CDs containing a mixture of songs and sounds of many musical instruments.

A similar apparatus for detecting chords from a musical acoustic signal is disclosed in Japanese Patent No. 3,156,299. This apparatus applies to an input acoustic signal digital filtering processes of different characteristics in a time-division manner to detect the level of each chromatic note, sums up the detected levels of chromatic notes having the same scale relationships in one octave, and detects the chords by using a predetermined number of chromatic notes having larger summed-up levels. Since each piece of musical-notation information included in the acoustic signal is not detected in this method, the problem occurring in the apparatus disclosed in Japanese Patent No. 2,876,861 does not occur.

PROBLEMS TO BE SOLVED BY THE INVENTION

In the tempo detection apparatus disclosed in Japanese Patent No. 3,127,406, a section for detecting the generation period of a chromatic note from the envelope thereof detects the maximum value of the envelop and detects a portion of the envelop having a predetermined ratio to the maximum value or more. However, when the predetermined ratio is determined uniquely in this manner, the sound generation timing may be detected or not detected depending on the magnitude of the sound volume, which largely affects the final tempo determination.

Further, a beat tracking system described in the article "Real-time Beat Tracking System" by Masataka Goto, applies FFT calculation to an input acoustic signal to obtain a frequency spectrum, and extracts the rising edge of sound from the frequency spectrum. Therefore, like the tempo detection apparatus disclosed in Japanese Patent No. 3,127,406, whether the rising edge of sound can be detected or not largely affects the final tempo determination.

What is important in these two tempo detection apparatuses is which chromatic note or which frequency is used to detect a rising edge of sound. If a musical piece happens to have a quick rhythm with a chromatic note (frequency) to be used for the detection, a faster tempo is erroneously detected.

In the apparatus for detecting chords from a musical acoustic signal disclosed in Japanese Patent No. 3,156,299, the levels of chromatic notes having the same scale relationship in one octave are summed up, in other words, the levels are summed up for each of 12 pitch names. Therefore, a plurality of chords composed of the same component notes, such as Am7 composed of la, do, mi, and sol, and C6 composed of do, mi, sol, and la, cannot be distinguished.

The chord detection apparatus disclosed in Japanese Patent No. 3,156,299 does not have a function of detecting a tempo or measure, but detects chords at predetermined time intervals. In other words, it is assumed that the apparatus is used for performances played according to a metronome that produces sound at a tempo specified in advance for a musical piece. When the apparatus is used for an acoustic signal obtained after a performance, such as a signal from a music CD, the apparatus can detect chords at predetermined time intervals but does not detect the tempo or measure. Therefore, the apparatus cannot output musical information in the form of a musical score called a chord score or a lead sheet, where a chord name is written in each measure.

Even when a tempo of a music is given to the apparatus, since, in general, the tempo of a performance recorded in a music CD is not constant and fluctuates to some extent, the apparatus cannot detect a chord correctly in each measure.

It is very difficult for a novice player to play a performance at a correct tempo according to a metronome that generates sound at a constant tempo. Generally, the tempo of his/her performance fluctuates.

This chord detection apparatus applies digital filtering processes of different characteristics to an input acoustic signal in a time-division manner because FFT calculation cannot provide good frequency resolution in a low range. However, FFT can provide a certain degree of frequency resolution even in a low range when an input acoustic signal is down-sampled and then subjected to FFT. Further, whereas the digital filtering process requires envelope extraction section in order to obtain the levels of filter output signals, FFT does not require such a section because the power spectrum obtained by FFT indicates the level at each frequency. In addition, FFT has a merit that a frequency resolution and a time resolution can be specified in a desired manner by appropriately selecting the number of FFT points and parameters of shift amounts.

SUMMARY OF THE INVENTION

It is an object of the present invention to resolve the foregoing issues and to provide a tempo detection apparatus capable of detecting, from the acoustic signal of a human performance of a music having a fluctuating tempo, the average tempo of the entire piece of music and the correct beat positions, and further the meter of the music and the position of the first beat.

Another object of the present invention is to provide a chord-name detection apparatus which enables a non-professional person having no special musical knowledge to detect a chord name from a musical acoustic signal (audio signal) of e.g. a music CD containing a mixed sound of a plurality of musical instruments.

More specifically, another object of the present invention is to provide a chord-name detection apparatus capable of determining a chord from the entire sound of an input acoustic signal without detecting each piece of musical-notation information.

Another object of the present invention is to provide a chord-name detection apparatus capable of distinguishing between chords having the same component notes and capable of detecting a chord in each measure even when a performance tempo fluctuates, or even for a sound source where the tempo of a performance is intentionally changed.

Another object of the present invention is to provide a chord-name detection apparatus capable of performing with a simplified configuration, a beat-detection process which requires a high time resolution (performed by the configuration of the above-described tempo detection apparatus) and at the same time, a chord-detection process which requires a high frequency resolution (performed by a configuration capable of detecting a chord name, in addition to the configuration of the above-described tempo detection apparatus).

Further objects of the present invention are to provide a tempo detection computer program and a chord-name detection computer program which implement the functions of the above-described apparatuses on a computer.

To achieve one of the foregoing objects, the present invention provides, a tempo detection apparatus comprising: input means for receiving an acoustic signal; chromatic-note-level detection means for applying an FFT calculation to the received acoustic signal at predetermined time intervals to obtain the level of each chromatic note at each of predetermined timings; beat detection means for summing up incremental values of respective levels of all the chromatic notes at each of the predetermined timings, to obtain the total of the incremental values indicating the degree of change of entire sound at each of the predetermined timings, and for detecting an average beat interval and the position of each beat from the total of the incremental values indicating the degree of change of entire sound at each of the predetermined timings; and measure detection means for calculating the average level of each chromatic note for each beat, for summing up incremental values of the respective average levels of all the chromatic notes for each beat to obtain a value indicating the degree of change of entire sound at each beat, and for detecting a meter and the position of a measure line from the value indicating the degree of change of entire sound at each beat.

In the tempo detection apparatus, the chromatic-note-level detection means obtains the level of each chromatic note at the predetermined time intervals from the acoustic signal received by the input means, the beat detection means sums up incremental values of respective levels of all the chromatic notes at each of the predetermined timings, to obtain the total of the incremental values indicating the degree of change of entire sound at each of the predetermined timings, and the beat detection means also detects an average beat interval (i.e. the tempo) and the position of each beat from the total of the incremental values indicating the degree of change of entire sound in each of the predetermined time intervals, and then, the measure detection means calculates the average level of each chromatic note for each beat, sums up the incremental values of the respective average levels of all the chromatic notes for each beat to obtain the value indicating the degree of change of all the notes at each beat, and detects the meter and the position of a measure line (position of the first beat) from the values indicating the degree of change of entire sound at each beat.

In summary, the level of each chromatic note at the predetermined time intervals is obtained from the input acoustic signal, the average beat interval (that is, the tempo) and the position of each beat are detected from changes of the level of each chromatic note at the predetermined time intervals, and then, the meter and the position of a measure line (position of the first beat) are detected from changes of the level of each chromatic note in each beat.

Further, the present invention provides a chord-name detection apparatus comprising: input means for receiving an acoustic signal; first chromatic-note-level detection means for applying an FFT calculation to the received acoustic signal at predetermined time intervals by using parameters suitable to beat detection and for obtaining the level of each chromatic note at each of predetermined timings; beat detection means for summing up incremental values of respective levels of all the chromatic notes at each of the predetermined timings, to obtain the total of the incremental values indicating the degree of change of entire sound at each of the predetermined timings, and for detecting an average beat interval and the position of each beat from the total of the incremental values indicating the degree of change of entire sound at each of the predetermined timings; measure detection means for calculating the average level of each chromatic note for each beat, for summing up incremental values of the respective average levels of all the chromatic notes for each beat to obtain a value indicating the degree of change of entire sound at each beat, and for detecting a meter and the position of a measure line from the value indicating the degree of change of entire sound at each beat; second chromatic-note-level detection means for applying an FFT calculation to the received acoustic signal at predetermined time intervals different from those used for the beat detection, by using parameters suitable to chord detection, to obtain the level of each chromatic note at each of predetermined timings; bass-note detection means for detecting a bass note from the level of a low note in each measure among the detected levels of chromatic notes; and chord-name determination means for determining a chord name in each measure according to the detected bass note and the level of each chromatic note.

In the above-described chord-name detection apparatus, when the bass-note detection means detects a plurality of bass notes in a measure, the chord-name determination means may divide the measure into a plurality of chord detection periods according to a result of the bass-note detection and determine a chord name in each chord detection period according to the bass note and the level of each chromatic note in each chord detection period.

In the chord-name detection apparatus, the first chromatic-note-level detection means applies an FFT calculation to the acoustic signal received by the input means, at predetermined time intervals by using the parameters suitable to beat detection to obtain the level of each chromatic note at the predetermined time intervals, and the beat detection means detects the average beat interval and the position of each beat from changes of the level of each chromatic note at the predetermined time intervals. Then, the measure detection means detects the meter and the position of a measure line from changes of the level of each chromatic note in each beat. Further, in the chord-name detection apparatus, the second chromatic-note-level detection means applies an FFT calculation to the received acoustic signal at predetermined time intervals different from those used for the beat detection, by using the parameters suited to chord detection, to obtain the level of each chromatic note at the predetermined time intervals. Then, the bass-note detection means detects a bass note from the level of a low note in each measure among the obtained levels of chromatic notes, and the chord-name determination means determines a chord name in each measure according to the detected bass note and the level of each chromatic note.

As described above, when the bass-note detection means detects a plurality of bass notes in a measure, the chord-name determination means may divide the measure into a plurality of chord detection periods according to a result of the bass-note detection and determine a chord name in each chord detection period according to the bass note and the level of each chromatic note in each chord detection period.

Further, the present invention defines a program executable in a computer, which enables the computer to implement the functions of the above-described tempo detection apparatus. Namely, the program is readable and executable in the computer, which is configured to realize the above-described means to achieve the foregoing objects, by using the construction of the computer. In that case, the computer can be a general-purpose computer having a central processing unit and can also be a special computer designed for specific processing. There is no limitation so long as the computer includes a central processing unit.

When the computer reads the program, the computer serves as the above-described means specified in the above-described tempo detection apparatus.

To achieve this object, the present invention provides a tempo detection program for making a computer to function as: input means for receiving an acoustic signal; chromatic-note-level detection means for applying an FFT calculation to the received acoustic signal at predetermined time intervals to obtain the level of each chromatic note at each of predetermined timings; beat detection means for summing up incremental values of respective levels of all the chromatic notes at each of the predetermined timings, to obtain the total of the incremental values indicating the degree of change of entire sound at each of the predetermined timings, and for detecting an average beat interval and the position of each beat from the total of the incremental values indicating the degree of change of entire sound at each of the predetermined timings; and measure detection means for calculating the average level of each chromatic note for each beat, for summing up incremental values of the respective average levels of all the chromatic notes for each beat to obtain a value indicating the degree of change of entire sound at each beat, and for detecting a meter and the position of a measure line from the value indicating the degree of change of entire sound at each beat.

Further, the present invention defines a program executable in a computer, which enables the computer to implement the functions of the above-described chord-name detection apparatus. Namely, when the computer reads the program, the computer serves as the above-described means specified in the above-described chord-name detection apparatus.

To achieve this object, the present invention provides a chord-name detection program for making a computer to function as: input means for receiving an acoustic signal; first chromatic-note-level detection means for applying an FFT calculation to the received acoustic signal at predetermined time intervals by using parameters suited to beat detection and for obtaining the level of each chromatic note at each of predetermined timings; beat detection means for summing up incremental values of respective levels of all the chromatic notes at each of the predetermined timings, to obtain the total of the incremental values, indicating the degree of change of entire sound at each of the predetermined timings, and for detecting an average beat interval and the position of each beat from the total of the incremental values indicating the degree of change of entire sound at each of the predetermined timings; measure detection means for calculating the average level of each chromatic note for each beat, for summing up incremental values of the respective average levels of all the chromatic notes for each beat to obtain a value indicating the degree of change of entire sound at each beat, and for detecting a meter and the position of a measure line from the value indicating the degree of change of entire sound at each beat; second chromatic-note-level detection means for applying an FFT calculation to the received acoustic signal at predetermined time intervals different from those used for the beat detection, by using parameters suitable to chord detection, to obtain the level of each chromatic note at each of predetermined timings; bass-note detection means for detecting a bass note from the level of a low note in each measure among the detected levels of chromatic notes; and chord-name determination means for determining a chord name in each measure according to the detected bass note and the level of each chromatic note.

Since the programs are configured as described above, when existing hardware resources are used to run the programs, the hardware resources easily implement the functions of the apparatuses of the present invention as new applications.

These programs can be easily used, distributed, and sold via communication networks. When existing hardware resources are used to run the programs, the hardware resources easily implement the functions of the apparatuses of the present invention as new applications.

Here, a part of the functions achievable by the above programs may be achieved by functions inherently built in the computers (built-in hardware functions or functions implemented by an operating system or an application program installed in the computers), and the programs may include instructions for calling or linking such functions built in the computers.

This is because, when some of the functions of the apparatuses of the present invention are implemented by e.g. functions of an operating system, even if there is no particular program or module that achieves those functions, substantially the same constructions is configured by calling or linking such functions of the operating system.

EFFECTS OF THE INVENTION

The tempo detection apparatuses and the tempo detection program of the present invention provide advantages in that, it enables to detect from the acoustic signal of a human performance of a musical piece having a fluctuating tempo, the average tempo of the entire piece of music, the correct beat positions, the meter of the musical piece and the position of the first beat.

The chord-name detection apparatuses and the chord-name detection program of the present invention provide advantages in that even persons other than professionals having special musical knowledge can detect chord names in a musical acoustic signal (audio signal) in which the sounds of a plurality of musical instruments are mixed, such as those in music CDs, from the overall sound without detecting each piece of musical-notation information.

Further, according to the configuration of the chord-name detection apparatuses and the chord-name detection program of the present invention, chords having the same component notes can be distinguished. Even from a performance whose tempo fluctuates, or even from a sound source of performance whose tempo is intentionally fluctuated, the chord name in each measure can be detected.

According to the chord-name detection apparatuses and the chord-name detection program of the present invention, a beat-detection process, that is, a process which requires a high time resolution (performed by the configuration of the tempo detection apparatuses), and a chord-detection process, that is, a process which requires a high frequency resolution (performed by a configuration capable of detecting a chord name, in addition to the configuration of the tempo detection apparatuses), can be performed at the same time with a simplified configuration.

BRIEF DESCRIPTION OF THE DRAWINGS

FIG. 15 is a view showing an example of confirmation screen of chord detection results.

DETAILED DESCRIPTION OF THE PREFERRED EMBODIMENTS

Figure 1:
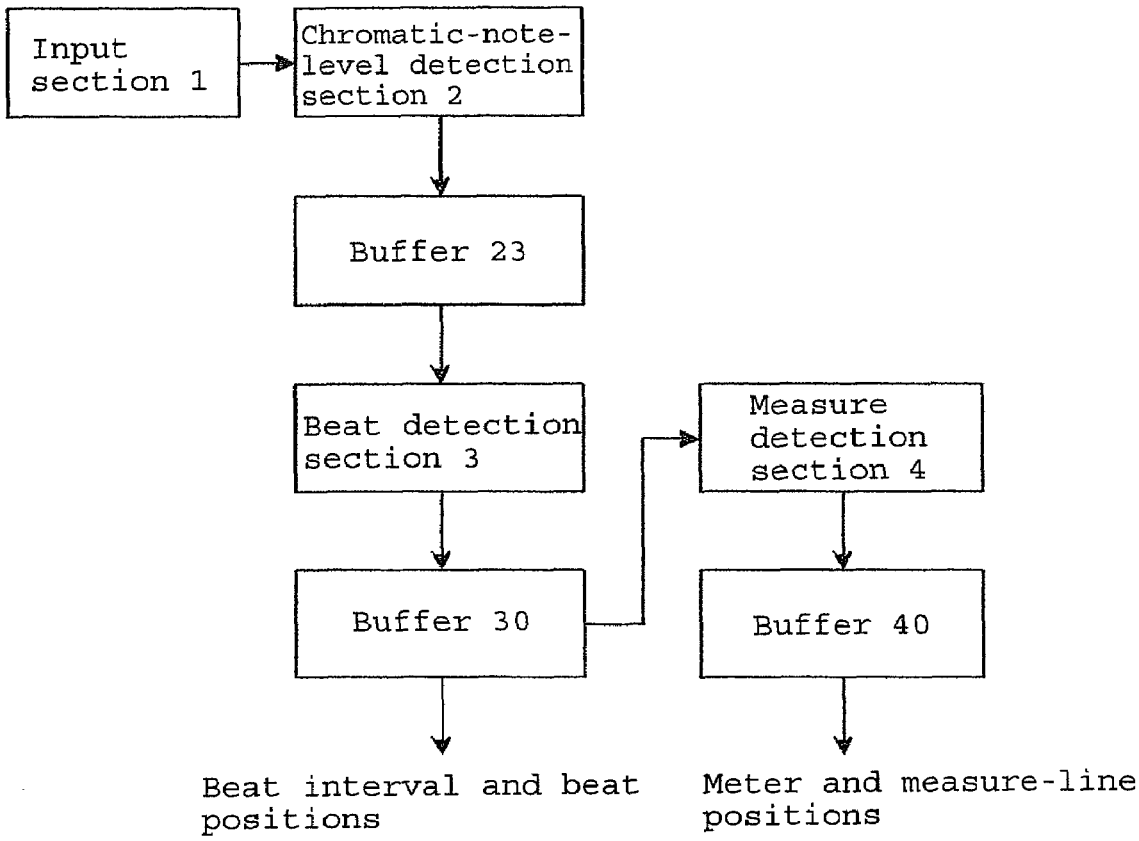
FIG. 1 is a block diagram of an entire tempo detection apparatus according to the present invention.

Examples of the present invention will be described below by referring to the drawings.

EXAMPLE 1

FIG. 1 is a block diagram of a tempo detection apparatus according to the present invention. In the figure, the tempo detection apparatus includes an input section 1 for receiving an acoustic signal; a chromatic-note-level detection section 2 for applying an FFT calculation to the received acoustic signal at predetermined time intervals to obtain the level of each chromatic note at each of predetermined timings; a beat detection section 3 for summing up respective incremental values of the levels of all the chromatic notes at each of the predetermined timings, to obtain the total of the incremental values indicating the degree of change of entire sound at each of the predetermined timings, and for detecting an average beat interval and the position of each beat from the total of the incremental values indicating the degree of change of entire sound at each of the predetermined timings; and a measure detection section 4 for calculating the average level of each chromatic note for each beat, for summing up respective incremental value of the respective average level of all the chromatic notes for each beat to obtain a value indicating the degree of change of entire sound at each beat, and for detecting a meter and the position of a measure line from the value indicating the degree of change of entire sound at each beat.

The input section 1 receives a musical acoustic signal from which the tempo is to be detected. An analog signal received from a microphone or other device may be converted to a digital signal by an A/D converter (not shown), or digitized musical data such as that in a music CD may be directly taken (ripped) as a file and opened. When a digital signal received in this way is a stereo signal, it is converted to a monaural signal to simplify subsequent processing.

Figure 2:
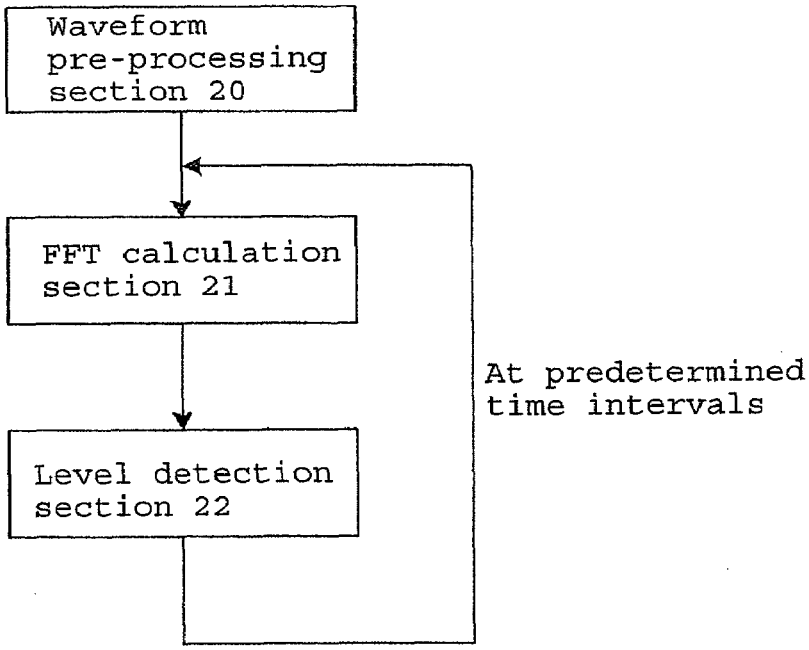
FIG. 2 is a block diagram of a chromatic-note-level detection section 2.

The digital signal is input to the chromatic-note-level detection section 2. The chromatic-note-level detection section 2 is constituted by sections shown in FIG. 2.

Among them, a waveform pre-processing section 20 down-samples the acoustic signal sent from the input section 1, at a sampling frequency suitable to the subsequent processing.

The down-sampling rate is determined by the range of a musical instrument used for beat detection. Specifically, to use the performance sounds of rhythm instruments having a high range, such as cymbals and hi-hats, for beat detection, it is necessary to set the sampling frequency after down-sampling to a high frequency. To mainly use the bass note, the sounds of musical instruments such as bass drums and snare drums, and the sounds of musical instruments having a middle range for beat detection, it is not necessary to set the sampling frequency after down-sampling to such a high frequency.

When it is assumed that the highest note to be detected is A6 (C4 serves as the center "do"), for example, since the fundamental frequency of A6 is about 1,760 Hz (when A4 is set to 440 Hz), the sampling frequency after down-sampling needs to be 3,520 Hz or higher, and the Nyquist frequency is thus 1,760 Hz or higher. Therefore, when the original sampling frequency is 44.1 kHz (which is used for music CDs), the down-sampling rate needs to be about one twelfth. In this case, the sampling frequency after down-sampling is 3,675 Hz.

Usually in down-sampling processing, a signal is passed through a low-pass filter which removes components having the Nyquist frequency (1,837.5 Hz in the current case), that is, half of the sampling frequency after down-sampling, or higher, and then data in the signal is skipped (11 out of 12 waveform samples are discarded in this case).

Down-sampling processing is performed in this way in order to reduce the FFT calculation time by reducing the number of FFT points required to obtain the same frequency resolution in FFT calculation to be performed after the down-sampling processing.

Such down-sampling is necessary when a sound source has already been sampled at a fixed sampling frequency, as in music CDs. However, when an analog signal input from a microphone or other device to the input section 1 is converted to a digital signal by the A/D converter, the waveform pre-processing section 20 can be omitted by setting the sampling frequency of the A/D converter to the sampling frequency after down-sampling.

When the down-sampling is finished in this way in the waveform pre-processing section 20, an FFT calculation section 21 applies an FFT (Fast Fourie Transform) calculation to the output signal of the waveform pre-processing section 20 at predetermined time intervals.

FFT parameters (number of FFT points and FFT window shift) should be set to values suitable for beat detection. Specifically, if the number of FFT points is increased to increase the frequency resolution, the FFT window size has to be enlarged to use a longer time period for one FFT cycle, reducing the time resolution. This FFT characteristic needs to be taken into account. (In other words, for beat detection, it is better to increase the time resolution by sacrificing the frequency resolution.) There is a method in which, instead of using a waveform having the same length as the window length, waveform data is specified only for a part of the window and the remaining part is filled with zeros to increase the number of FFT points without sacrificing the time resolution. However, a sufficient number of waveform samples needs to be set up in order to also detect a low-note level correctly.

Considering the above points, in this example, the number of FFT points is set to 512, the window shift is set to 32 samples, and filling with zeros is not performed. When the FFT calculation is performed with these settings, the time resolution is about 8.7 ms, and the frequency resolution is about 7.2 Hz. A time resolution of 8.7 ms is sufficient because the length of a thirty-second note is 25 ms in a musical piece having a tempo of 300 quarter notes per minute.

The FFT calculation is performed in this way at the predetermined time intervals; the squares of the real part and the imaginary part of the FFT result are summed and the sum is square-rooted to calculate the power spectrum; and the power spectrum is sent to a level detection section 22.

The level detection section 22 calculates the level of each chromatic note from the power spectrum calculated in the FFT calculation section 21. The FFT calculates only the powers at frequencies that are integer multiples of the value obtained by dividing the sampling frequency by the number of FFT points. Therefore, the following process is performed to detect the level of each chromatic note from the power spectrum. Namely, with respect to each chromatic note (from C1 to A6), the power of the spectrum providing the maximum power in a power spectrum range corresponding to a frequency range of 50 cents (100 cents correspond to one semitone) above and below the fundamental frequency of the note, is obtained as the level of the note.

When the levels of all the chromatic notes are detected, they are stored in a buffer. The waveform reading position is advanced by a predetermined time interval (which corresponds to 32 samples in the above case), and the processes in the FFT calculation section 21 and the level detection section 22 are performed again. This set of steps is repeated until the waveform reading position reaches the end of the waveform.

By the above-described processing, the level of each chromatic note of the acoustic signal input to the input section 1 at each time of the predetermined time intervals, is stored in a buffer 23.

Next, the structure of the beat detection section 3, shown in FIG. 1, will be described. The beat detection section 3 performs processing according to a procedure shown in FIG. 3.

The beat detection section 3 detects an average beat interval (i.e. tempo) and the positions of beats based on a change of the level of each chromatic note obtained at the predetermined time intervals (hereinafter, this predetermined time interval is referred to as a frame), the level being output from the chromatic-note-level detection section 2. The beat detection section 3 first calculates, in step S100, the total of respective incremental values of the levels of all the chromatic notes (the total of respective incremental values of levels from the preceding frame, of all the chromatic notes; if the level is reduced from the preceding frame, zero is added).

When the level of the i-th chromatic note at frame time "t" is designated as $L_i(t)$, an incremental value $L_{addi}(t)$ of the level of the i-th chromatic note is as shown in the following expression 1. The total L(t) of the incremental values of the levels of all the chromatic notes at frame time "t" can be calculated by the following expression 2 by using $L_{addi}(t)$, where T indicates the total number of chromatic notes.

$$L_{addi}(t) = \begin{cases} L_i(t) - L_i(t-1) & (\text{when } L_i(t-1) \leq L_i(t)) \\ 0 & (\text{when } L_i(t-1) > L_i(t)) \end{cases} \quad \text{Expression 1}$$

$$L(t) = \sum_{i=0}^{T-1} L_{addi}(t) \quad \text{Expression 2}$$

The total value L(t) indicates the degree of change of entire sound in each frame. This value suddenly becomes large when notes start sounding, and the value increases as the number of notes that start sounding at the same time increases. Since notes start sounding at the position of a beat in many musical pieces, it is highly possible that the position where this value becomes large is the position of a beat.

Figure 4:
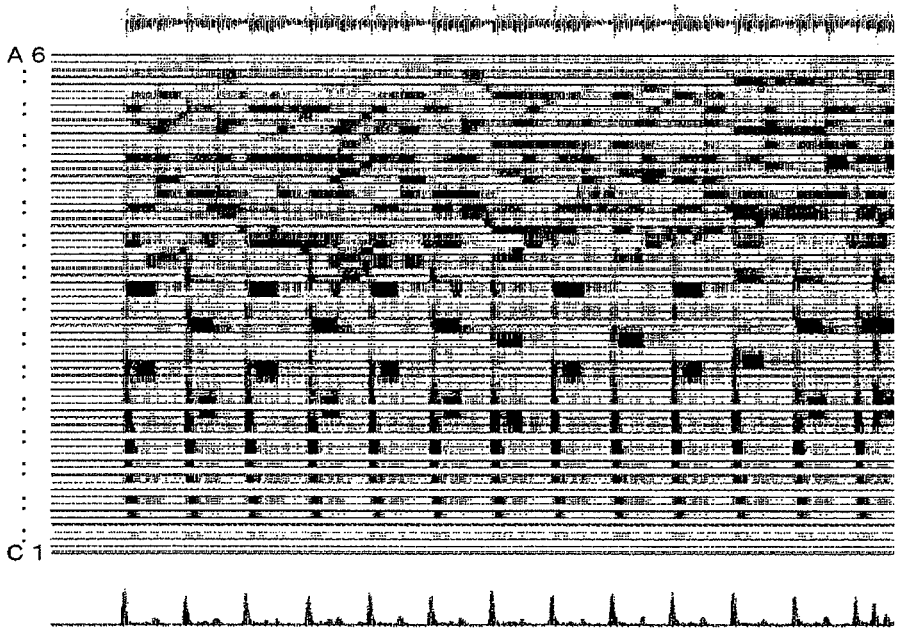
FIG. 4 is a graph showing a waveform of a part of a musical piece, the level of each chromatic note, and the total of the incremental values of the levels of the chromatic notes.

For example, FIG. 4 shows the waveform of a part of a musical piece, the level of each chromatic note, and the total of the incremental values of levels of the chromatic notes. The top portion indicates the waveform, the middle portion indicates the level of each chromatic note in each frame with black and white gradation (in the range of C1 to A6 in this figure, lower position shows lower note and higher position shows higher note), and the bottom portion indicates the total of the incremental values of levels of the chromatic notes in each frame. Since the level of each chromatic note shown in this figure is output from the chromatic-note-level detection section 2, the frequency resolution is about 7.2 Hz, the levels of some chromatic notes (G#2 and lower) cannot be calculated and are not shown. Even though the levels of some low chromatic notes cannot be measured, there is no problem because the purpose is to detect beats.

As shown in the bottom part of the figure, the total of the incremental values of levels of the chromatic notes has peaks periodically. The positions of these periodic peaks are those of beats.

To obtain the positions of beats, the beat detection section 3 first obtains the time interval between these periodic peaks, that is, the average beat interval. The average beat interval can be obtained from the autocorrelation of the total of the incremental values of levels of the chromatic notes (in step S102 in FIG. 3).

The autocorrelation $\phi(\tau)$ of the total L(t) of the incremental values of levels of the chromatic notes in a frame time "t" is given by the following expression 3:

$$\phi(\tau) = \frac{\sum_{t=0}^{N-\tau-1} L(t) \cdot L(t+\tau)}{N-\tau} \quad \text{Expression 3}$$

where N indicates the total number of frames and $\tau$ indicates a time delay.

Figure 5:
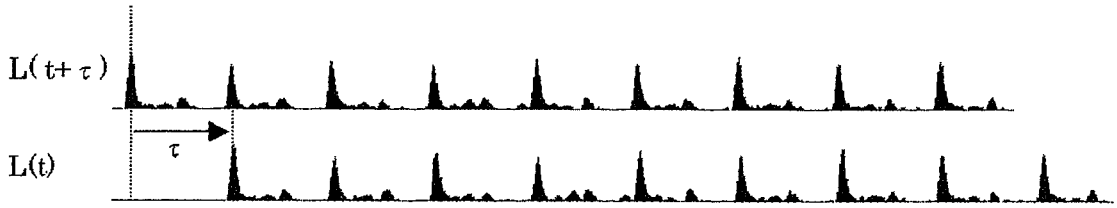
FIG. 5 is a view showing the concept of autocorrelation calculation.

FIG. 5 shows the concept of the autocorrelation calculation. As shown in the figure, when the time delay "$\tau$" is an integer multiple of the period of peaks of L(t), $\phi(\tau)$ becomes a large value. Therefore, when the maximum value of $\phi(\tau)$ is obtained in a prescribed range of "$\tau$", the tempo of the musical piece is obtained.

The range of "$\tau$" where the autocorrelation is obtained needs to be changed according to an expected tempo range of the musical piece. For example, when calculation is performed in a range of 30 to 300 quarter notes per minute in metronome marking, the range where autocorrelation is calculated is from 0.2 to 2.0 seconds. The conversion from time (seconds) to frames is given by the following expression 4.

$$\text{Number of frames} = \frac{\text{Time(seconds)} \times \text{sampling frequency}}{\text{Number of samples per frame}} \quad \text{Expression 4}$$

The beat interval may be set to "$\tau$" where the autocorrelation $\phi(\tau)$ is maximum in the range. However, since "$\tau$" where the autocorrelation is maximum in the range is not necessarily the beat interval for all musical pieces, it is desired that candidates for the beat interval be obtained from "$\tau$" values where the autocorrelation is local maximum in the range (in step S104 in FIG. 3) and that the user be asked to determine the beat interval from those plural candidates (in step S106 in FIG. 3).

When the beat interval is determined in this way (the determined beat interval is designated as "$\tau_{max}$"), the initial beat position is determined first.

Figure 6:
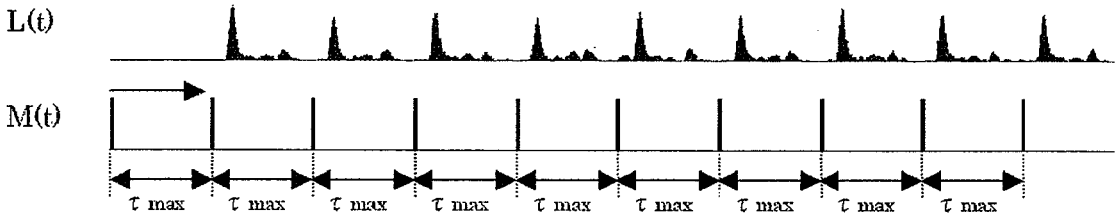
FIG. 6 is a view showing a method for determining the initial beat position.

A method for determining the initial beat position is described with reference to FIG. 6. In FIG. 6, the upper row indicates L(t) that is the total of the incremental values in level of the chromatic notes at frame time "t", and the lower row indicates M(t) that is a function having a value of an integer multiple of the determined beat interval "$\tau_{max}$". The function M(t) is expressed by the following expression 5.

$$M(t) = \begin{cases} 1 & (\text{when "}t\text{" is an integer multiple of "}\tau_{max}\text{"}) \\ 0 & (\text{otherwise}) \end{cases} \quad \text{Expression 5}$$

The cross-correlation of L(t) and M(t) is calculated with the function M(t) shifted in a range of 0 to "$\tau_{max}$"−1.

The cross-correlation r(s) can be calculated from the characteristics of the function M(t) by the following expression 6.

$$r(s) = \sum_{j=0}^{n-1} L(\tau_{max} \cdot j + s) \ (0 \leqq s < \tau_{max}) \quad \text{Expression 6}$$

In this case, "n" may be determined appropriately according to the length of an initial soundless part ("n"=10 in the case shown in FIG. 6).

The cross-correlation r(s) is obtained in the "s" range of from 0 to "$\tau_{max}$"−1. The initial beat position is in the s-th frame where r(s) is maximized.

Figure 3:
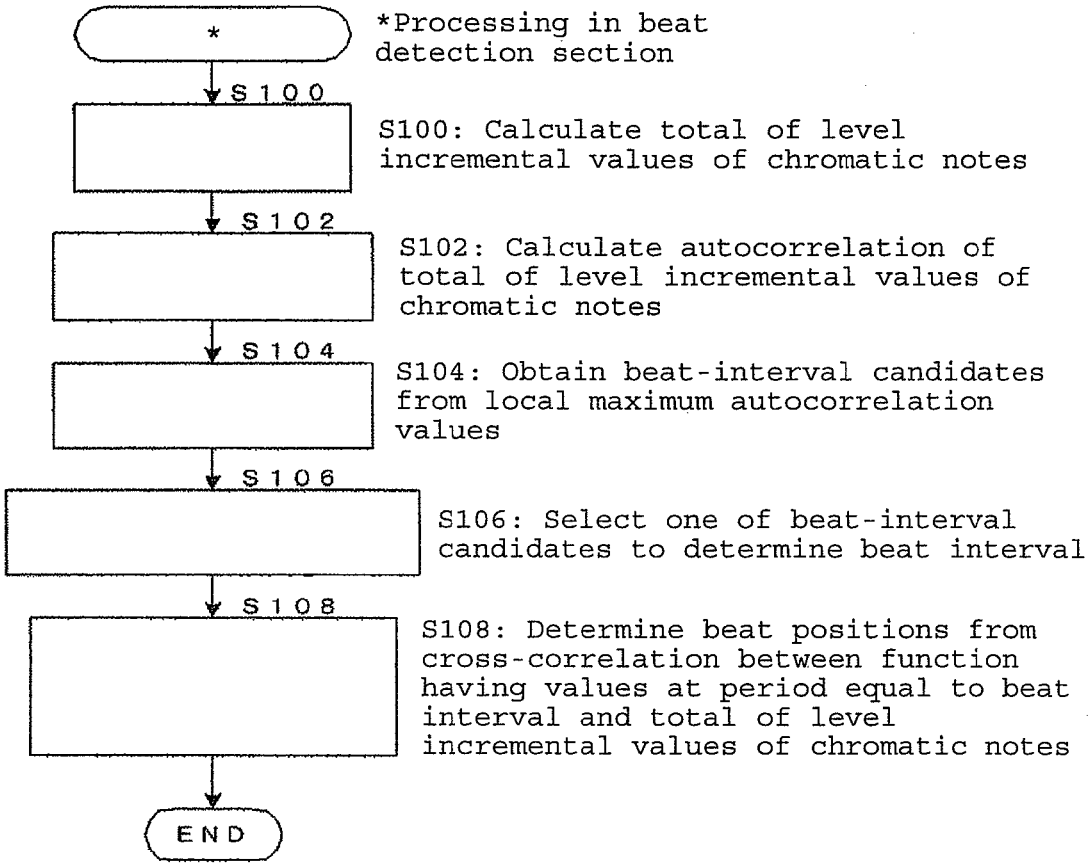
FIG. 3 is a flowchart showing a processing flow in a beat detection section 3.

Once the initial beat position is determined, subsequent beat positions are determined one by one (in step S108 in FIG. 3).

A method therefor will be described with reference to FIG. 7. It is assumed that the initial beat is found at the position of a triangular mark in FIG. 7. The second beat position is determined to be a position where cross-correlation between L(t) and M(t) becomes maximum in the vicinity of a tentative beat position away from the initial beat position by the beat interval "$\tau_{max}$". In other words, when the initial beat position is $b_0$, the value of "s" which maximizes r(s) in the following expression 7 is obtained. In the expression, "s" indicates a shift from the tentative beat position and is an integer in the range shown in the expression 7. "F" is a fluctuation parameter; it is suitable to set "F" to about 0.1, but "F" may be set larger for a music where tempo fluctuation is large. "n" may be set to about 5.

Figure 8:
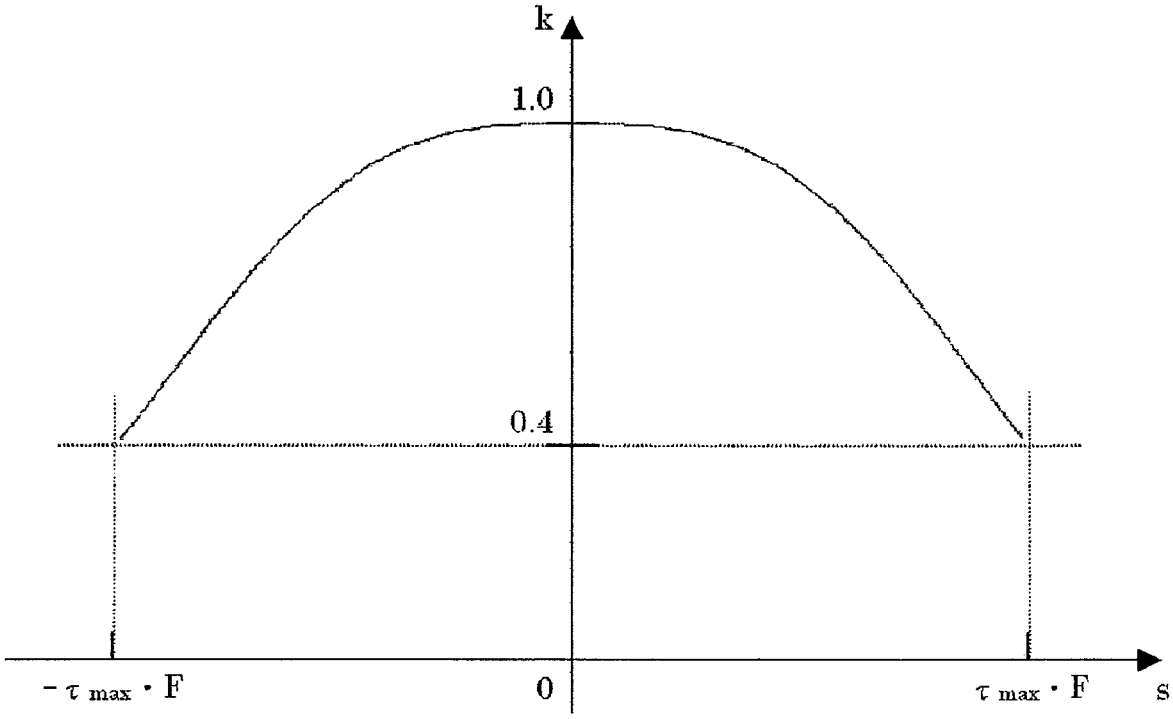
FIG. 8 is a graph showing the distribution of a coefficient k which changes according to the value of s.

In the expression, "k" is a coefficient that is changed according to the value of "s" and is assumed to have a normal distribution such as that shown in FIG. 8.

$$r(s) = \sum_{j=1}^{n} k \cdot L(b_0 + \tau_{max} \cdot j + s) \quad \text{Expression 7}$$

$$(-\tau_{max} \cdot F \leqq s \leqq \tau_{max} \cdot F)$$

When the value of "s" that maximizes r(s) is found, the second beat position $b_1$ is calculated by the following expression 8.

$$b_1 = b_0 + \tau_{max} + s \quad \text{Expression 8}$$

The third beat position and subsequent beat positions can be obtained in the same way.

In a musical piece where the tempo hardly changes, beat positions can be obtained until the end of the musical piece by this method. However, in an actual performance, the tempo fluctuates to some extent or becomes slow in parts in some cases.

To handle such tempo fluctuation, the following method can be used.

Figure 7:
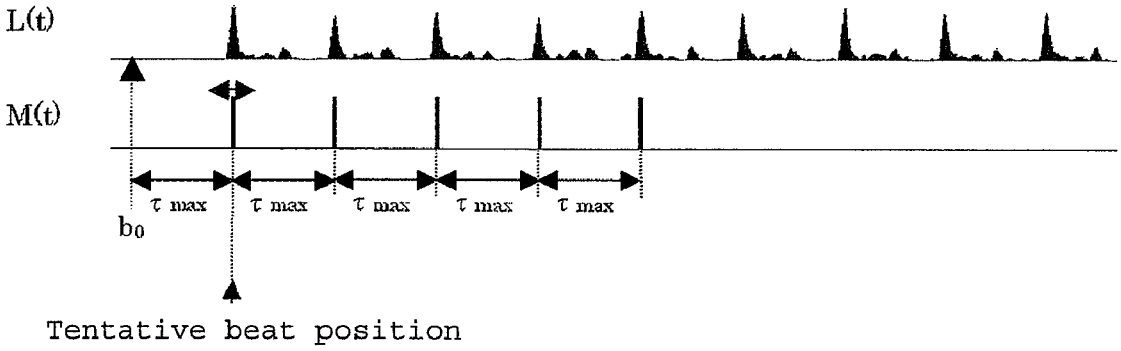
FIG. 7 is a view showing a method for determining subsequent beat positions after the initial beat position has been determined.
Figure 9:
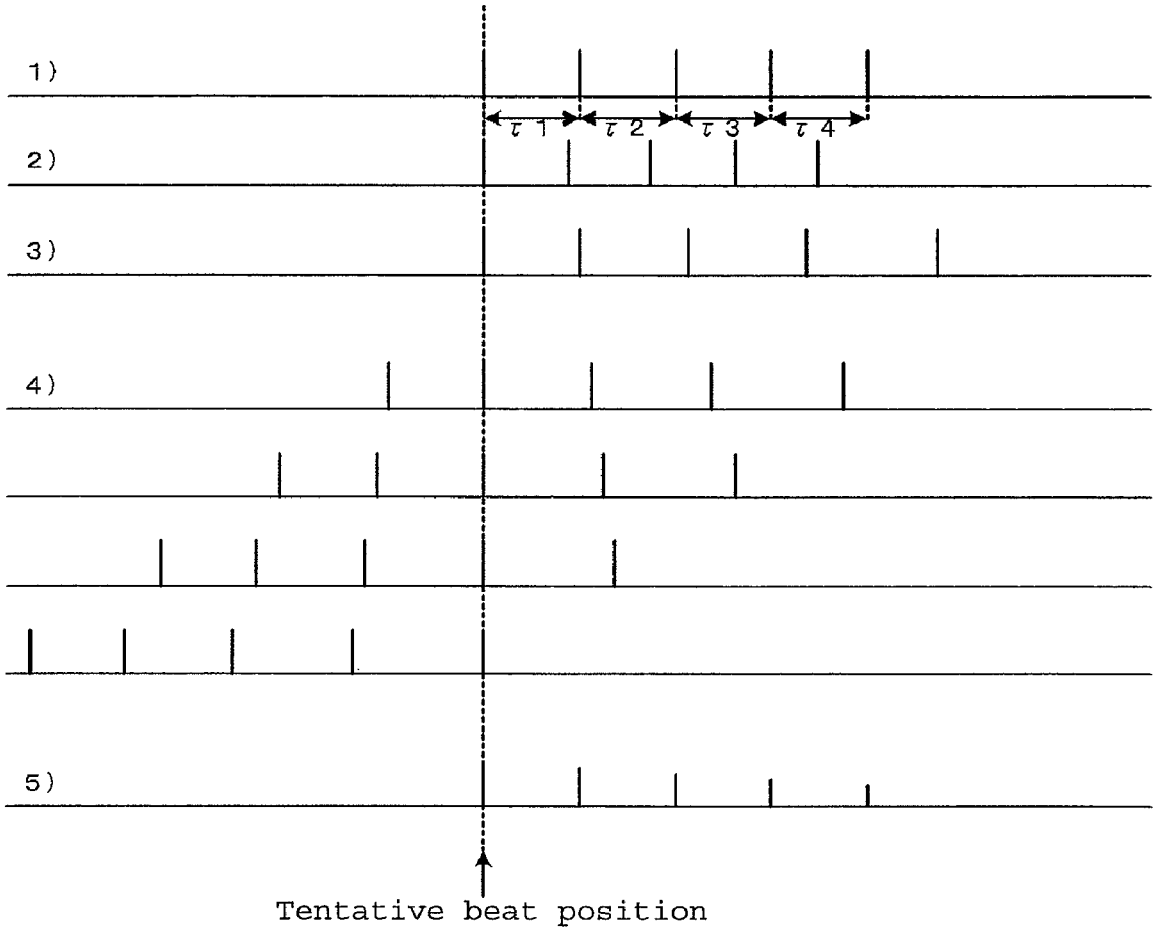
FIG. 9 is a view showing a method for determining second and subsequent beat positions.

In the method, the function M(t) shown in FIG. 7 is changed as shown in FIG. 9.

Row 1 of FIG. 9 indicates the method described above, wherein $$\tau_1 = \tau_2 = \tau_3 = \tau_4 = \tau_{max}$$

where $\tau_1$, $\tau_2$, $\tau_3$, and $\tau_4$ indicate the time periods between pulses from the start, as shown in the figure.

Row 2) indicates a method wherein the time periods $\tau_1$ to $\tau_4$ are equally expanded or shrinked, that is, $\tau_1 = \tau_2 = \tau_3 = \tau_4 = \tau_{max} + s$ $(-\tau_{max} \times F \leqq s \leqq \tau_{max} \times F)$.

This approach can handle a case where the tempo suddenly changes.

Row 3) is a method for handling rit. (ritardando: gradually slower) or for accel. (accelerando: gradually faster), wherein the time periods between pulses are calculated as follows:

$$\tau_1 = \tau_{max}$$

$$\tau_2 = \tau_{max} + 1 \times s$$

$$\tau_3 = \tau_{max} + 2 \times s$$

$$\tau_4 = \tau_{max} + 4 \times s \ (-\tau_{max} \times F \leqq s \leqq \tau_{max} \times F).$$

The coefficients used here, 1, 2, and 4, are just examples and may be changed according to the magnitude of a tempo change.

Row 4) indicates a method wherein a zone to search the beat position is changed in relation to the five pulse positions for rit. or accel. in e.g. the method of 3).

By combining all of the these methods and calculating cross-correlation between L(t) and M(t), beat positions can be determined even from a musical piece having a fluctuating tempo. In the methods of 2) and 3), the value of the coefficient "k" used for correlation calculation also needs to be changed according to the value of "s".

The magnitudes of the five pulses are currently set to be the same. However, the magnitude of only the pulse at the position to obtain the beat (a tentative beat position in FIG. 9) may be set larger or the magnitude may be set so as to be gradually smaller as the pulse leaves from the position to obtain the beat, in order to enhance the total of the incremental values of levels of the chromatic notes at the position to obtain a beat (indicated by row 5) in FIG. 9).

When the position of each beat is determined in the manner described above, the results are stored in a buffer 30. At the same time, the results may be displayed so that the user can check and correct them if they are wrong.

Figure 10:
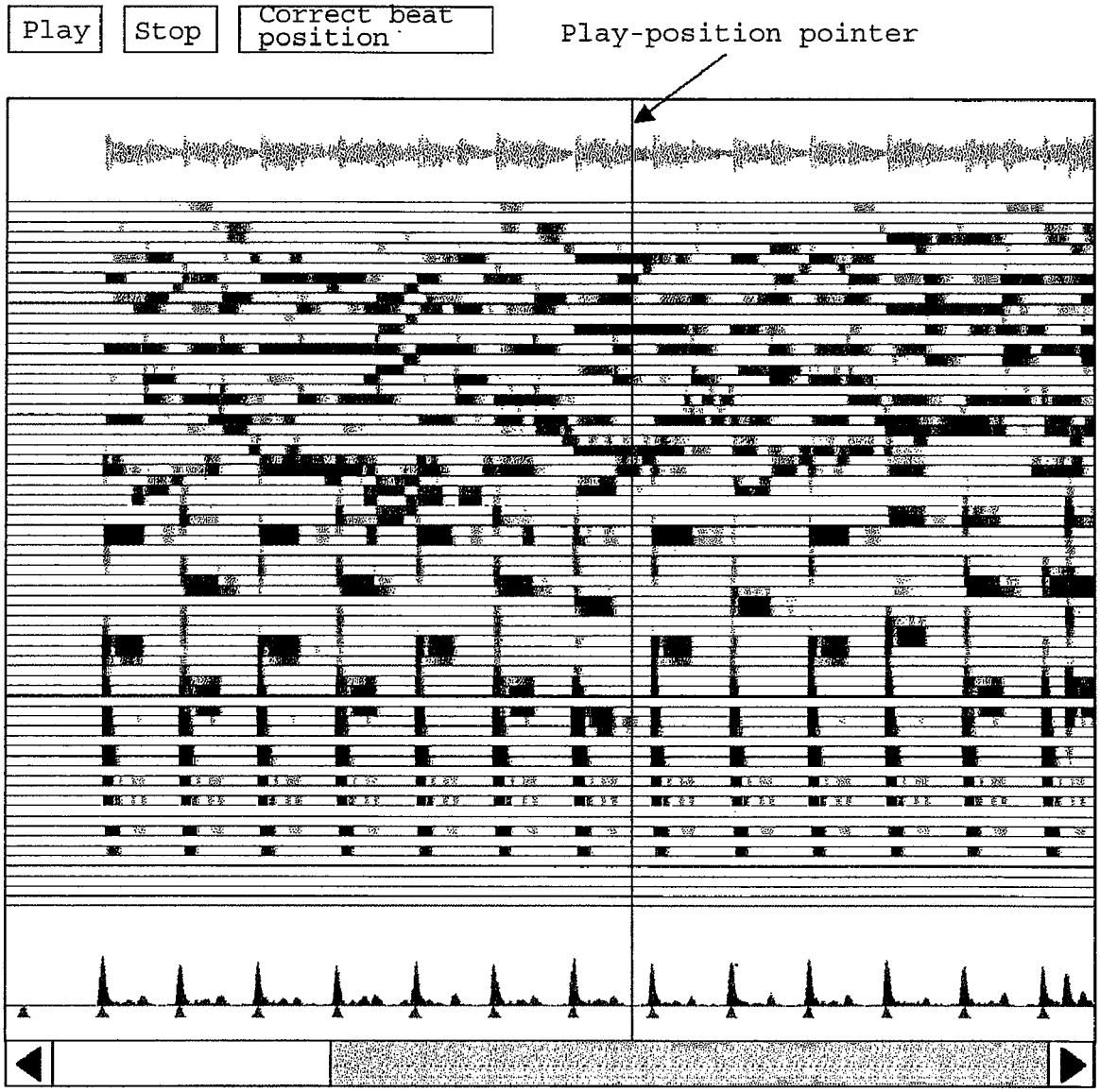
FIG. 10 is a view showing an example of confirmation screen of beat detection results.

FIG. 10 shows an example of confirmation screen of beat detection results. Triangular marks indicate the positions of detected beats.

When a "play" button is pressed, the current musical acoustic signal is D/A converted and played back from a speaker. The current playback position is indicated by a play-position pointer such as a vertical line in the figure, and the user can check for errors in beat detection positions while listening to the music. Furthermore, when sound of e.g. a metronome is played back at beat-position timings in addition to the playback of the original waveform, checking can be performed not only visually but also aurally, facilitating determination of detection errors. As a method for playing back the sound of a metronome, for example, a MIDI device can be used.

A beat-detection position is corrected by pressing a "correct beat position" button. When this button is pressed, a crosshairs cursor appears on the screen. In a zone where the initial beat position was erroneously detected, a user moves the cursor to the correct position and clicks. This operation causes to clear all beat positions on and after a position slightly (for example, by half of $\tau_{max}$) before the clicked position, set the clicked position as a tentative beat position, and re-detect subsequent beat positions.

Next, detecting a meter and a measure will be described.

The beat positions are determined in the processing described above. The degree of change of all the notes in each beat is then obtained. The degree of a sound change in each beat is calculated from the level of each chromatic note in each frame, output from the chromatic-note-level detection section 2.

When the frame number of the j-th beat is designated as $b_j$ and the frame numbers of the previous beat and the subsequent beat are designated as $b_{j-1}$ and $b_{j+1}$, respectively, the degree of change of sound at the j-th beat can be calculated in the following steps. Namely, the average level of each chromatic note from frames $b_{j-1}$ to $b_j - 1$ and the average level of each chromatic note from frames $b_j$ to $b_{j+1} - 1$ are calculated; an incremental value between these average levels is calculated, which indicates the degree of change of each chromatic note; and the total of the degrees of changes of the all chromatic notes is calculated, which indicates the degree of change of sound at the j-th beat.

In other words, when the level of the i-th chromatic note at frame time "t" is designated as $L_i(t)$, since the average level $L_{avgi}(j)$ of the i-th chromatic note in the j-th beat is expressed by the following expression 9, the degree of change $B_{addi}(j)$ of the i-th chromatic note in the j-th beat is expressed by the following expression 10.

$$L_{avgi}(j) = \frac{\sum_{t=b_j}^{b_{j+1}-1} L_i(t)}{b_{j+1} - b_j} \quad \text{Expression 9}$$

$$B_{addi}(j) = \begin{cases} L_{avgi}(j) - L_{avgi}(j-1) & (\text{when } L_{avgi}(j-1) \leq L_{avgi}(j)) \\ 0 & (\text{when } L_{avgi}(j-1) > L_{avgi}(j)) \end{cases} \quad \text{Expression 10}$$

Therefore, the degree of change B(j) of all the notes in the j-th beat is expressed by the following expression 11, where T indicates the total number of chromatic notes.

$$B(j) = \sum_{i=0}^{T-1} B_{addi}(j) \quad \text{Expression 11}$$

Figure 11:
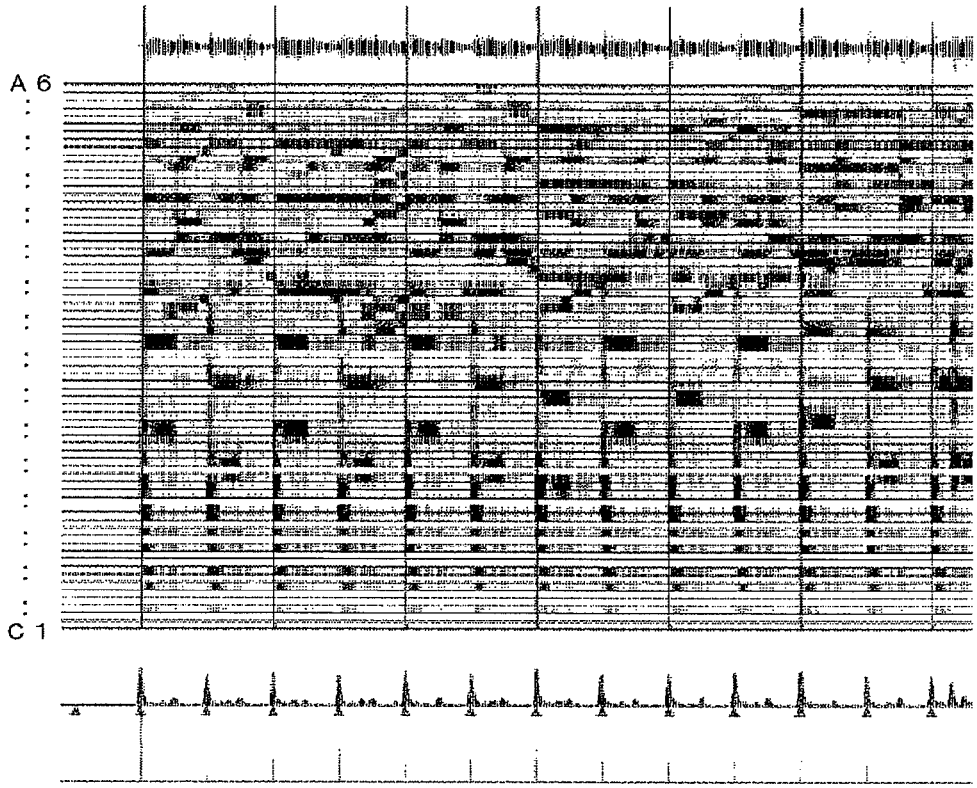
FIG. 11 is a view showing an example of confirmation screen of measure detection results.

In FIG. 11, the bottom part indicates the degree of change of sound in each beat. From the degree of change of sound in each beat, the meter and the first beat position are obtained.

The meter is obtained from the autocorrelation of the degree of change of sound in each beat. Generally, it is considered that most musical pieces have a sound change at the first beat. Therefore, the meter can be obtained from the autocorrelation of the degree of change of sound in each beat. For example, by using the following expression 12, the autocorrelation $\phi(\tau)$ of the degree of change B(j) of sound in each beat is obtained at each delay "$\tau$" in the range of from 2 to 4, and the delay "$\tau$" which maximizes the autocorrelation $\phi(\tau)$ is used as the meter number:

$$\phi(\tau) = \frac{\sum_{j=0}^{N-\tau-1} B(j) \cdot B(j+\tau)}{N - \tau} \quad \text{Expression 12}$$

where N indicates the total number of beats. $\phi(\tau)$ is calculated at each $\tau$ in the range of 2 to 4, and the delay $\tau$ which maximized $\phi(\tau)$ is used as the number of meters.

Next, the first beat is obtained. The position where the degree of change B(j) of sound in each beat is maximum is set as the first beat. In other words, when "$\tau$" that maximizes $\phi(\tau)$ is designated as "$\tau_{max}$" and "k" that maximizes X(k) shown in the following expression 13 is designated as "$k_{max}$", the $k_{max}$-th beat indicates a first beat position, and the positions at intervals "$\tau_{max}$" from the $k_{max}$-th beat are subsequent first beat positions.

$$X(k) = \frac{\sum_{n=0}^{n_{max}} B(\tau_{max} \cdot n + k)}{n_{max} + 1} \quad (0 \leqq k < \tau_{max}) \quad \text{Expression 13}$$

where $n_{max}$ is the maximum "n", provided that $\tau_{max} \cdot n + k < N$.

When the meter and first beat positions (the positions of measure lines) are determined in the manner described above, the results are stored in a buffer 40. At the same time, it is desired that the results be displayed on the screen to allow the user to change them. Since this method cannot handle musical pieces having a changing meter, it is necessary to ask the user to specify a position where the meter is changed.

With the construction of the above-described embodiment, from the acoustic signal of a human performance of a music having a fluctuating tempo, it is possible to detect the average tempo of the entire piece of music and correct beat positions, and further, the meter of the music and first beat positions.

EXAMPLE 2

Figure 12:
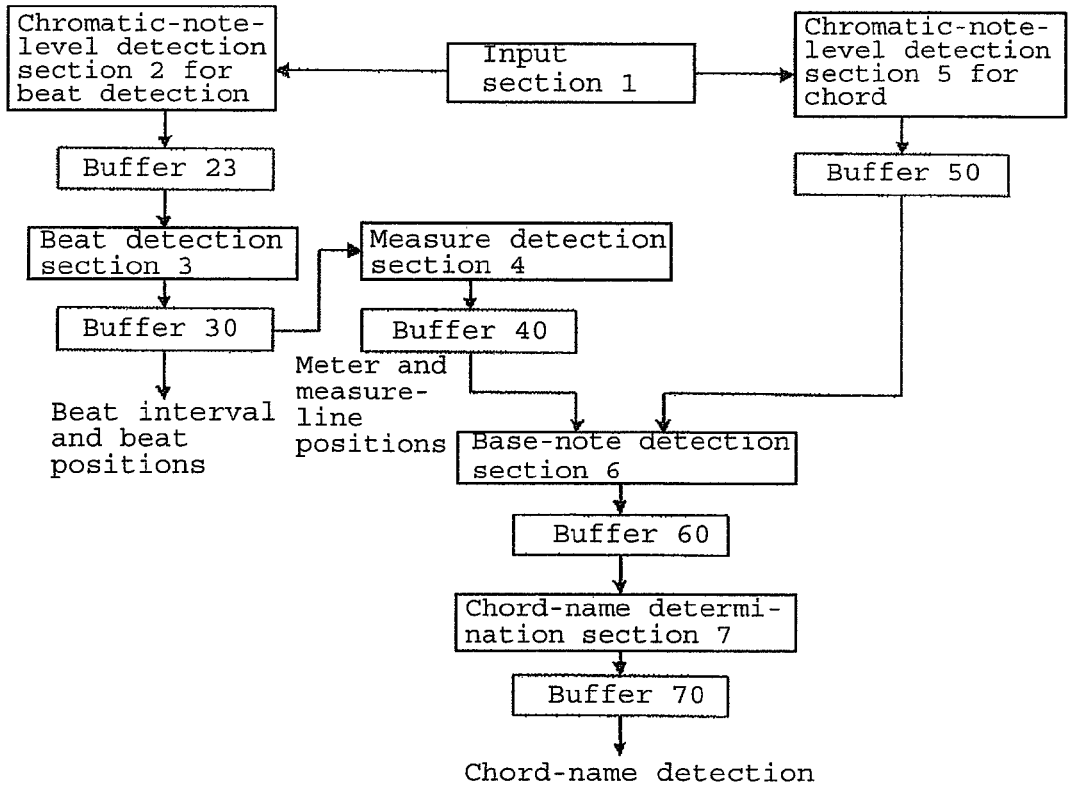
FIG. 12 is a block diagram of an entire chord-name detection apparatus according to a second embodiment of the present invention.

FIG. 12 is a block diagram of a chord-name detection apparatus according to the present invention. In the figure, the structures of a beat detection section and a measure detection section are basically the same as those in the Example 1. Since the constructions of a tempo detection part and a chord detection part are partially different from those in Example 1, a description thereof will be made below without mathematical expressions, with some portions already mentioned above.

In the figure, the chord-name detection apparatus includes an input section 1 for receiving an acoustic signal; a chromatic-note-level detection section 2 for beat detection for applying an FFT calculation to the received acoustic signal at predetermined time intervals by using parameters suitable to beat detection to obtain the level of each chromatic note at each of predetermined timings; a beat detection section 3 for summing up incremental values of respective levels of all chromatic notes at each of the predetermined time intervals, to obtain the total of the incremental values indicating the degree of change of entire sound at each of the predetermined timings, and for detecting an average beat interval and the position of each beat from the total of the incremental values indicating the degree of change of entire sound at each of the predetermined timings; a measure detection section 4 for calculating the average level of each chromatic note for each beat, for summing up incremental values of respective average levels of all chromatic notes for each beat to obtain a value indicating the degree of change of entire sound at each beat, and for detecting a meter and the position of a measure line from the value indicating the degree of change of entire sound at each beat; a chromatic-note-level detection section 5 for chord detection for applying an FFT calculation to the received acoustic signal at predetermined time intervals different from those used for the beat detection described above, by using parameters suitable to chord detection, to obtain the level of each chromatic note at each of predetermined timings; a bass-note detection section 6 for detecting a bass note from the level of a low chromatic note in each measure among the detected levels of chromatic notes; and a chord-name determination section 7 for determining a chord name in each measure according to the detected bass note and the level of each chromatic note.

The input section 1 receives a musical acoustic signal from which chords are to be detected. Since the basic construction thereof is the same as the construction of the input section 1 of Example 1, described above, a detailed description thereof is omitted here. If a vocal sound, which is usually located at the center, disturbs subsequent chord detection, the waveform at the right-hand channel may be subtracted from the waveform at the left-hand channel to cancel the vocal sound.

A digital signal output from the input section 1 is input to the chromatic-note-level detection section 2 for beat detection and to the chromatic-note-level detection section 5 for chord detection. Since these chromatic-note-level detection sections are each formed of the sections shown in FIG. 2 and have exactly the same construction, a single chromatic-note-level detection section can be used for both purposes with its parameters only being changed.

A waveform pre-processing section 20, which is used as a component of the chromatic-note-level detection sections 2 and 5, has the same structure as described above and down-samples the acoustic signal received from the input section 1, at a sampling frequency suitable to the subsequent processing. The sampling frequency after downsampling, that is, the down-sampling rate, may be changed between beat detection and chord detection, or may be identical to save the down-sampling time.

In beat detection, the down-sampling rate is determined according to a note range used for beat detection. To use the performance sounds of rhythm instruments such as cymbals or hi-hats having a high range, for beat detection, it is necessary to set a high sampling frequency after down-sampling. To mainly use the bass note, the sounds of musical instruments such as bass drums and snare drums, and the sounds of musical instruments having a middle range for beat detection, the same down-sampling rate as that used in the following chord detection may be used.

The down-sampling rate used in the waveform pre-processing section 20 for chord detection is changed according to a chord-detection range. The chord-detection range means a range used for chord detection in the chord-name determination section 7. When the chord-detection range is the range from C3 to A6 (C4 serves as the center "do"), for example, since the fundamental frequency of A6 is about 1,760 Hz (when A4 is set to 440 Hz), the sampling frequency after down-sampling needs to be 3,520 Hz or higher, and the Nyquist frequency is thus 1,760 Hz or higher. Therefore, when the original sampling frequency is 44.1 kHz (which is used for music CDs), the down-sampling rate needs to be about one twelfth. In this case, the sampling frequency after down-sampling is 3,675 Hz.

Usually in down-sampling processing, a signal is passed through a low-pass filter which removes components having the Nyquist frequency (1,837.5 Hz in the current case), that is, half of the sampling frequency after down-sampling, or higher, and then data in the signal is skipped (11 out of 12 waveform samples are discarded in the current case). The same reason applies as that described in the first embodiment.

When down-sampling is finished in this way in the waveform pre-processing section 20, an FFT calculation section 21 applies an FFT (Fast Fourier Transform) calculation to the output signal of the waveform pre-processing section 20 at predetermined time intervals.

FFT parameters (number of FFT points and FFT window shift) are set to different values between beat detection and chord detection. If the number of FFT points is increased to increase the frequency resolution, the FFT window size is enlarged to use a longer time period for one FFT cycle, reducing the time resolution. This FFT characteristic needs to be taken into account. (In other words, for beat detection, it is better to increase the time resolution with the frequency resolution sacrificed.) There is a method in which, instead of using a waveform having the same length as the window length, waveform data is specified only in a part of the window and the remaining part is filled with zeros to increase the number of FFT points without sacrificing the time resolution. However, a sufficient number of waveform samples needs to be set up in order to also detect low-note power correctly in the case of this example.

Considering the above points, in this example, for beat detection, the number of FFT points is set to 512, the window shift is set to 32 samples, and filling with zeros is not performed; for chord detection, the number of FFT points is set to 8,192, the window shift is set to 128 samples; and 1,024 waveform samples are used in one FFT cycle. When the FFT calculation is performed with these settings, the time resolution is about 8.7 ms and the frequency resolution is about 7.2 Hz for beat detection; and the time resolution is about 35 ms and the frequency resolution is about 0.4 Hz for chord detection. Since each chromatic note whose level is to be obtained falls in the range from C1 to A6, a frequency resolution of about 0.4 Hz in chord detection is sufficient because the smallest frequency difference between fundamental frequencies, which is between C1 and C#1, is about 1.9 Hz. A time resolution of 8.7 ms in beat detection is sufficient because the length of a thirty-second note is 25 ms in a music having a tempo of 300 quarter notes per minutes.

The FFT calculation is performed in this way at the predetermined time intervals; the squares of the real part and the imaginary part of the FFT result are added and the sum is square-rooted to calculate the power spectrum; and the power spectrum is sent to a level detection section 22.

The level detection section 22 calculates the level of each chromatic note from the power spectrum calculated in the FFT calculation section 21. The FFT calculates just the powers of frequencies that are integer multiples of the value obtained when the sampling frequency is divided by the number of FFT points. Therefore, the same process as that in Example 1 is performed to detect the level of each chromatic note from the power spectrum. Specifically, the level of the spectrum having the maximum power among power spectra corresponding to the frequencies falling in the range of 50 cents (100 cents correspond to one semitone) above and below the fundamental frequency of each chromatic note (from C1 to A6) is set to the level of the chromatic note.

When the levels of all the chromatic notes have been detected, they are stored in a buffer. The waveform reading position is advanced by a predetermined time interval (which corresponds to 32 samples for beat detection and to 128 samples for chord detection in the previous case), and the processes in the FFT calculation section 21 and the level detection section 22 are performed again. This set of steps is repeated until the waveform reading position reaches the end of the waveform.

With the above-described processing, the level of each chromatic note at the predetermined time intervals of the acoustic signal input to the input section 1, is stored in a buffer 23 and a buffer 50 for beat detection and chord detection, respectively.

Next, since the beat detection section 3 and the measure detection section 4 in FIG. 12 have the same constructions as the beat detection section 3 and the measure detection section 4 in the first embodiment, detailed descriptions thereof are omitted here.

The positions of measure lines (the frame numbers of the measures) are determined in the same procedure by the same construction as in the first embodiment. Then, the bass note in each measure is detected.

The bass note is detected from the level of each chromatic note in each frame, output from the chromatic-note-level detection section 5 for chord detection.

Figure 13:
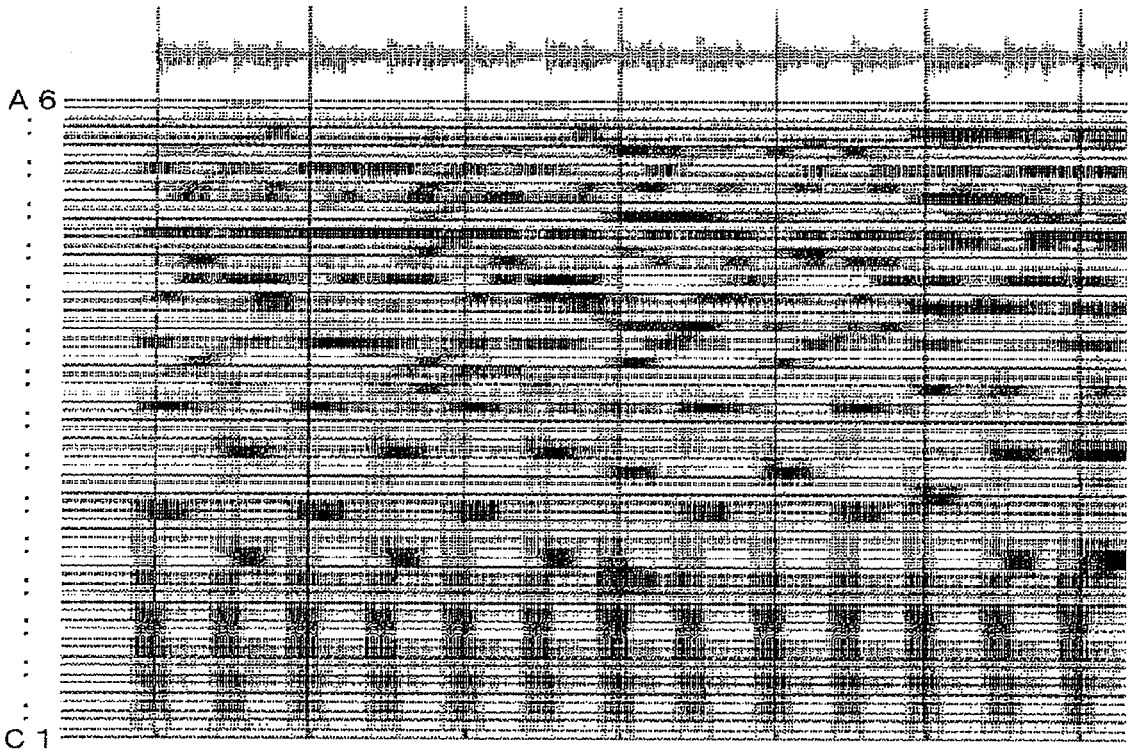
FIG. 13 is a graph showing the level of each chromatic note at each frame in the same part of musical piece, output from a chromatic-note-level detection section 5 for chord detection.

FIG. 13 shows the level of each chromatic note in each frame at the same portion in the same piece of music as that shown in FIG. 4 in the first embodiment, output from the chromatic-note-level detection section 5 for chord detection. As shown in the figure, since the frequency resolution in the chromatic-note-level detection section 5 for chord detection is about 0.4 Hz, the levels of all the chromatic notes from C1 to A6 are extracted.

Since it is possible that the bass note differs between a first half and a second half of each measure, the bass-note detection section 6 detects the bass note in each of the first half and the second half in each measure. When the same bass note is detected in the first half and the second half, the bass note is determined to be the bass note of the measure and a chord is detected in the entire measure. When different bass notes are detected in the first half and the second half, the chord is also detected in each of the first half and the second half. In some cases, each measure may be divided further into quarters thereof.

The bass note is obtained from the average strength of the level of each chromatic note in a bass-note detection range in a bass-note detection period.

When the level of the i-th chromatic note at frame time "It" is designated as $L_i(t)$, the average level $L_{avgi}(f_s, f_e)$ of the i-th chromatic note from frame $f_s$ to frame $f_e$ can be calculated by the following expression 14:

$$L_{avgi}(f_s, f_e) = \frac{\sum_{t=f_s}^{f_e} L_i(t)}{f_e - f_s + 1} \quad (f_s \leqq f_e) \qquad \text{Expression 14}$$

The bass-note detection section 6 calculates the average levels in the bass-note detection range, for example, in the range from C2 to B3, and determines the chromatic note having the largest average level as the bass note. To prevent the bass note from being erroneously detected in a musical piece where no sound is included in the bass-note detection range or in a portion where no sound is included, an appropriate threshold may be specified so that the bass note is ignored if the average level of the detected bass note is equal to or smaller than the threshold. When the bass note is regarded as an important factor in subsequent chord detection, it may be determined whether the detected bass note continuously keeps a predetermined level or more during the bass-note detection period to select only a more reliable one as the bass note. Further, instead of determining the chromatic note having the largest average level in the bass-note detection range as the bass note, the bass note may be determined by such a method that the average level of each of 12 pitch names in the range is calculated, the pitch name having the largest average level is determined to be the bass pitch name, and the chromatic note having the largest average level among the chromatic notes having the bass pitch name in the bass-note detection range is determined as the bass note.

When the bass note is determined, the result is stored in a buffer 60. The bass note detection result may be displayed on a screen to allow a user to correct it if it is wrong. Since the bass-note range may change depending on the musical piece, the user may be allowed to change the bass-note detection range.

Figure 14:
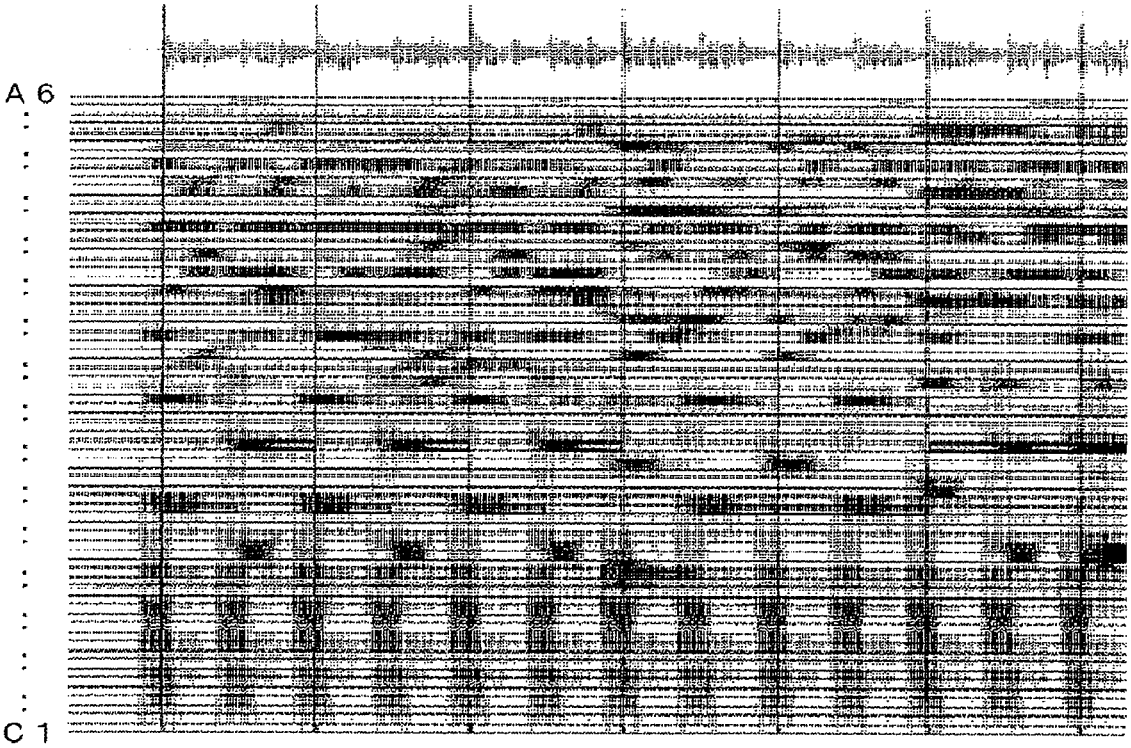
FIG. 14 is a graph showing an example of display of bass-note detection results obtained by a bass-note detection section 6.

FIG. 14 shows a display example of the bass-note detection result obtained by the bass-note detection section 6.

The chord-name determination section 7 determines the chord name according to the average level of each chromatic note in each chord detection period.

In this example, the chord detection period and the bass-note detection period are the same. The average level of each chromatic note in a chord detection range, for example, in the range from C3 to A6, is calculated in the chord detection period, the names of several top chromatic notes in average level are detected, and chord-name candidates are selected according to the names of these notes and the name of the bass note.

Since a note having a high level is not necessarily a component of the chord, several notes, for example five notes, are detected, all combinations of at least two of those notes are picked up, and according to the names of the notes in each combination and the name of the bass note, chord-name candidates are selected.

Also in chord detection, notes having average levels which are not higher than a threshold may be ignored. In addition, the user may be allowed to change the chord detection range. Furthermore, instead of extracting chord-component candidates sequentially from the chromatic note having the highest average level in the chord detection range, the average level of each of 12 pitch names in the chord detection range is calculated to extract chord-component candidates sequentially from the pitch name having the highest average level.

To extract chord-name candidates, the chord-name determination section 7 searches a chord-name data base which stores chord types (such as "m" and M7") and intervals of chord-component notes from the root notes. Specifically, all combinations of at least two of the five detected note names are extracted; it is determined one by one whether the intervals among these extracted notes match the intervals among chord-component notes stored in the chord-name data base; when they match, the root note is found from the name of a note included in the chord-component notes; and a chord type is assigned to the name of the root note to determine the chord name. Since a root note or a fifth note of a chord may be omitted in a musical instrument that plays the chord, even if these types of notes are not included, the corresponding chord-name candidates are extracted. When the bass note is detected, the note name of the bass note is added to the chord names of the chord-name candidates. In other words, when a root note of a chord and the bass note have the same note name, nothing needs to be done. When they differ, a fraction chord is used.

If too many chord-name candidates are extracted in the above-described method, a restriction may be applied according to the bass note. Specifically, when the bass note is detected, if the bass note name is not included in the root names of any chord-name candidate, the chord-name candidate is deleted.

When a plurality of chord-name candidates is extracted, the chord-name determination section 7 calculates a likelihood (how likely it is to happen) in order to select one of the plurality of chord-name candidates.

The likelihood is calculated from the average of the strengths of the levels of all chord-component notes in the chord detection range and the strength of the average level of the root notes of the chord in the bass-note detection range. Specifically, when the average of the average levels of all component notes of an extracted chord-name candidate in the chord detection zone is designated as $L_{avgc}$ and the average level of the root notes of the chord in the bass-note detection zone is designated as $L_{avgr}$, the likelihood is calculated as the average of these two averages as shown in the following expression 15.

$$\text{Likelihood} = \frac{L_{avgc} + L_{avgr}}{2} \qquad \text{Expression 15}$$

When a plurality of notes having the same pitch name is included in the chord detection range or in the bass-note detection range, the note having the largest average level among them is used for chord detection or bass-note detection. Alternatively, the average levels of chromatic notes corresponding to each of the 12 pitch names may be averaged and the average level of each of the 12 pitch names thus obtained may be used in each of the chord detection range and the bass-note detection range.

Further, musical knowledge may be introduced into the calculation of the likelihood. For example, the level of each chromatic note is averaged in all frames; the average levels of notes corresponding to each of the 12 pitch names, are averaged to calculate the strength of each of the 12 pitch names; and the key of the musical piece is detected from the distribution of the strength. The diatonic chord of the key is multiplied by a prescribed constant to increase the likelihood. Or, the likelihood may be reduced for a chord having a component note(s) which is outside the notes in the diatonic scale of the key, according to the number of the notes outside the diatonic scale. Further, patterns of common chord progressions may be stored in a data base, and the likelihood for a chord candidate which is found, in comparison with the data base, to be included in the patterns of common chord progressions may be increased by being multiplied by a prescribed constant.

The name of the chord candidate having the largest likelihood is determined to be the chord name. Chord-name candidates may be displayed together with their likelihood to allow the user to select the chord name.

In any of these cases, when the chord-name determination section 7 determines the chord name, the result is stored in a buffer 70 and is also displayed on the screen.

FIG. 15 shows a display example of chord detection results obtained by the chord-name determination section 7. In addition to displaying the detected chords on the screen in this way, it is preferred that the detected chords and the bass notes be played back by using a MIDI device or the like. This is because, in general, it cannot be determined whether the displayed chords are correct just by looking at the names of the chords.

According to the configuration of the present embodiment described above, even non-professional persons having no special musical knowledge can detect chord names in an input musical acoustic signal such as those in music CDs in which the sounds of a plurality of musical instruments are mixed, according to the overall sound without detecting each piece of musical-notation information.

Further, according to the configuration of the present embodiment, chords having the same component notes can be distinguished. Even if the performance tempo fluctuates, or even if a sound source outputs a performance whose tempo is intentionally fluctuated, the chord name in each measure can be detected.

Especially, only with the simplified configuration of the present embodiment, a beat-detection process, that is, a process which requires a high time resolution (performed by the construction of the above-described tempo detection apparatus), and a chord-detection process, that is, a process which requires a high frequency resolution (performed by a construction capable of detecting a chord name, in addition to the configuration of the above-described tempo detection apparatus), can be performed at the same time.

The tempo detection apparatus, the chord-name detection apparatus, and the programs implementing the functions of those apparatuses according to the present invention are not limited to those described above with reference to the drawings, and can be modified in various manners within the scope of the present invention.

The tempo detection apparatus, the chord-name detection apparatus, and the programs capable of implementing the functions of those apparatuses according to the present invention can be used in various fields, such as video editing processing for synchronizing events in a video track with beat timing in a musical track when a musical promotion video is created; audio editing processing for finding the positions of beats by beat tracking and for cutting and pasting the waveform of an acoustic signal of a musical piece; live-stage event control for controlling elements, such as the color, brightness, and direction of lighting, and a special lighting effect, in synchronization with a human performance and for automatically controlling audience hand clapping time and audience cries of excitement; and computer graphics in synchronization with music.

The entire disclosure of Japanese Patent Application No. 2005-208062, filed on Jul. 19, 2005, including the specification, claims, drawings and summary, is incorporated herein by reference in its entirety.

What is claimed is:

1. A tempo detection apparatus comprising:

input means for receiving an acoustic signal;

chromatic-note-level detection means for applying an FFT calculation to the received acoustic signal at predetermined time intervals to obtain the level of each chromatic note at each of predetermined timings;

beat detection means for summing up incremental values of respective levels of all the chromatic notes at each of the predetermined timings, to obtain the total of the incremental values indicating the degree of change of entire sound at each of the predetermined timings, and for detecting an average beat interval and the position of each beat from the total of the incremental values indicating the degree of change of entire sound at each of the predetermined timings; and measure detection means for calculating the average level of each chromatic note for each beat, for summing up incremental values of the respective average levels of all the chromatic notes for each beat to obtain a value indicating the degree of change of entire sound at each beat, and for detecting a meter and the position of a measure line from the value indicating the degree of change of entire sound at each beat.

2. The tempo detection apparatus according to claim 1, wherein in order to obtain the average beat interval and the position of each beat, the beat detection means obtains the average beat interval from an auto-correlation of the total of the incremental values of the levels of all the chromatic notes, and calculates a cross-correlation between the total of the incremental values of the levels of all the chromatic notes and a function having a period equal to the average beat interval to obtain a first beat position and then also calculates a cross-correlation between the total of the incremental values of the levels of all the chromatic notes and the function having a period equal to the average beat interval to obtain second and subsequent beat positions to detect the position of each beat.

3. The tempo detection apparatus according to claim 1, wherein in order to obtain the average beat interval and the position of each beat, the beat detection means obtains the average beat interval from an auto-correlation of the total of the incremental values of the levels of all the chromatic notes, and calculates a cross-correlation between the total of the incremental values of the levels of all the chromatic notes and a function having a period equal to the average beat interval to obtain a first beat position and then calculates a cross-correlation between the total of the incremental values of the levels of all the chromatic notes and a function having a period equal to the average beat interval plus or minus a certain amount to obtain second and subsequent beat positions to detect the position of each beat.

4. The tempo detection apparatus according to claim 1, wherein in order to obtain the average beat interval and the position of each beat, the beat detection means obtains the average beat interval from an auto-correlation of the total of the incremental values of the levels of all the chromatic notes, and calculates a cross-correlation between the total of the incremental values of the levels of all the chromatic notes and a function having a period equal to the average beat interval to obtain a first beat position and then calculates a cross-correlation between the total of the incremental values of the levels of all the chromatic notes and a function having periods gradually increasing from or gradually decreasing from the average beat interval to obtain second and subsequent beat positions to detect the position of each beat.

5. The tempo detection apparatus according to claim 1, wherein in order to obtain the average beat interval and the position of each beat, the beat detection means obtains the average beat interval from an auto-correlation of the total of the incremental values of the levels of all the chromatic notes, and calculates a cross-correlation between the total of the incremental values of the levels of all the chromatic notes and a function having a period equal to the average beat interval to obtain a first beat position and then calculates a cross-correlation between the total of the incremental values of the levels of all the chromatic notes and a function having periods gradually increasing from or gradually decreasing from the average beat interval, with beat positions in the middle being shifted, to obtain second and subsequent beat positions to detect the position of each beat.

6. The tempo detection apparatus according to claim 1, wherein in order to obtain the meter and the position of a first beat, the measure detection means calculates the average level of each chromatic note for each beat, sums up incremental values of respective average levels of all the chromatic notes for each beat to obtain the value indicating the degree of change of entire sound at each beat, and obtains the meter from an autocorrelation of the value indicating the degree of change of entire sound at each beat, and then specifies the position of the measure line by setting a position where the value indicating the degree of change of entire sound in each beat interval is the maximum to the position of a first beat.

7. A chord-name detection apparatus comprising:

input means for receiving an acoustic signal;

first chromatic-note-level detection means for applying an FFT calculation to the received acoustic signal at predetermined time intervals by using parameters suitable to beat detection and for obtaining the level of each chromatic note at each of predetermined timings;

beat detection means for summing up incremental values of respective levels of all the chromatic notes at each of the predetermined timings, to obtain the total of the incremental values indicating the degree of change of entire sound at each of the predetermined timings, and for detecting an average beat interval and the position of each beat from the total of the incremental values indicating the degree of change of entire sound at each of the predetermined timings;

measure detection means for calculating the average level of each chromatic note for each beat, for summing up incremental values of the respective average levels of all the chromatic notes for each beat to obtain a value indicating the degree of change of entire sound at each beat, and for detecting a meter and the position of a measure line from the value indicating the degree of change of entire sound at each beat;

second chromatic-note-level detection means for applying an FFT calculation to the received acoustic signal at predetermined time intervals different from those used for the beat detection, by using parameters suitable to chord detection, to obtain the level of each chromatic note at each of predetermined timings;

bass-note detection means for detecting a bass note from the level of a low note in each measure among the detected levels of chromatic notes; and chord-name determination means for determining a chord name in each measure according to the detected bass note and the level of each chromatic note.

8. The chord-name detection apparatus according to claim 7, wherein, when the bass-note detection means detects a plurality of bass notes in a measure, the chord-name determination means divides the measure into some chord detection periods according to a result of the bass-note detection and determines a chord name in each chord detection period according to the bass note and the level of each chromatic note in each chord detection period.

9. A tempo detection program for causing a computer to function as:

input means for receiving an acoustic signal;

chromatic-note-level detection means for applying an FFT calculation to the received acoustic signal at predetermined time intervals to obtain the level of each chromatic note at each of predetermined timings;

beat detection means for summing up incremental values of respective levels of all the chromatic notes at each of the predetermined timings, to obtain the total of the incremental values indicating the degree of change of entire sound at each of the predetermined timings, and for detecting an average beat interval and the position of each beat from the total of the incremental values indicating the degree of change of entire sound at each of the predetermined timings; and measure detection means for calculating the average level of each chromatic note for each beat, for summing up incremental values of the respective average levels of all the chromatic notes for each beat to obtain a value indicating the degree of change of entire sound at each beat, and for detecting a meter and the position of a measure line from the value indicating the degree of change of entire sound at each beat.

10. A chord-name detection program for causing a computer to function as:

input means for receiving an acoustic signal;

first chromatic-note-level detection means for applying an FFT calculation to the received acoustic signal at predetermined time intervals by using parameters suited to beat detection and for obtaining the level of each chromatic note at each of predetermined timings;

beat detection means for summing up incremental values of respective levels of all the chromatic notes at each of the predetermined timings, to obtain the total of the incremental values indicating the degree of change of entire sound at each of the predetermined timings, and for detecting an average beat interval and the position of each beat from the total of the incremental values indicating the degree of change of entire sound at each of the predetermined timings;

measure detection means for calculating the average level of each chromatic note for each beat, for summing up incremental values of the respective average levels of all the chromatic notes for each beat to obtain a value indicating the degree of change of entire sound at each beat, and for detecting a meter and the position of a measure line from the value indicating the degree of change of entire sound at each beat;

second chromatic-note-level detection means for applying an FFT calculation to the received acoustic signal at predetermined time intervals different from those used for the beat detection, by using parameters suitable to chord detection, to obtain the level of each chromatic note at each of predetermined timings;

bass-note detection means for detecting a bass note from the level of a low note in each measure among the detected levels of chromatic notes; and chord-name determination means for determining a chord name in each measure according to the detected bass note and the level of each chromatic note.

* * * * *